US010274157B2

(12) United States Patent
Li

(10) Patent No.: US 10,274,157 B2
(45) Date of Patent: Apr. 30, 2019

(54) LED APPARATUS

(71) Applicant: LEEDARSON AMERICA INC., Smyrna, GA (US)

(72) Inventor: Yongchuan Li, Smyrna, GA (US)

(73) Assignee: LEEDARSON AMERICA INC., Smyrna, GA (US)

( * ) Notice: Subject to any disclaimer, the term of this patent is extended or adjusted under 35 U.S.C. 154(b) by 0 days.

(21) Appl. No.: 15/680,107

(22) Filed: Aug. 17, 2017

(65) Prior Publication Data

US 2019/0056085 A1 Feb. 21, 2019

(51) Int. Cl.

| | |
|---|---|
| ***F21V 5/00*** | (2018.01) |
| ***F21V 29/89*** | (2015.01) |
| ***F21V 5/04*** | (2006.01) |
| ***F21V 23/00*** | (2015.01) |
| ***F21V 23/06*** | (2006.01) |
| ***F21S 8/00*** | (2006.01) |
| *F21Y 115/30* | (2016.01) |
| *F21Y 115/10* | (2016.01) |

(52) U.S. Cl.

CPC ..... *F21V 5/002* (2013.01); *F21S 8/003* (2013.01); *F21V 5/04* (2013.01); *F21V 23/004* (2013.01); *F21V 23/06* (2013.01); *F21V 29/89* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2014/0204560 | A1* | 7/2014 | Tachino | F21K 9/00 362/95 |
| 2014/0301062 | A1* | 10/2014 | David | F21V 9/30 362/84 |
| 2015/0308660 | A1* | 10/2015 | Chiu | F21V 13/04 362/308 |
| 2016/0131327 | A1* | 5/2016 | Moon | H01L 33/58 362/235 |
| 2016/0186959 | A1* | 6/2016 | Kim | F21V 5/04 362/311.02 |

* cited by examiner

*Primary Examiner* — Ashok Patel

(74) *Attorney, Agent, or Firm* — Chun-Ming Shih

(57) ABSTRACT

A LED apparatus has a LED plate, a lens plate, a cup body, a driver plate and two metal pins. The lens plate has a central lens and a plurality of micro optical structures. The cup body has a dome portion, a tube portion and a bottom portion. The dome portion and the tube portion are manufactured together as a single body. A portion of light emitting from the LED plate runs through the central lens of the lens plate to form a focus light beam and another portion of light emitting from the LED modules running through the plurality of micro optical structures to form soft light. Two input terminals of the driver plate are inserted into the two metal pins.

15 Claims, 6 Drawing Sheets

LED APPARATUS

FIELD OF INVENTION

The present invention is related to an electronic apparatus and more particularly related to a LED apparatus.

BACKGROUND

LED light is a important light source in today world. There are various functions for LED light. For example, spotlight devices are widely used in various areas, including to better show a painting or a portion of a dinner table. However, spotlight devices usually takes higher price and thus making them less adopted than needed. Current spotlight devices usually have more complicated structures and thus make them having higher cost.

Therefore, it would be a technical challenge to design a simpler structure of spotlight device and would be even better if heat dissipation and assembling factors are also considered in such design.

SUMMARY OF INVENTION

According to a first embodiment of the present invention, a LED apparatus has a LED plate, a metal cup, a lens plate, a cup body and a driver plate.

The LED plate has a plurality of LED modules, a base plate and two connectors. The plurality of LED modules and the two connectors are mounted on the base plate. The base plate may be made of metal like aluminum.

The metal cup has a bottom surface attaching to the back side of the base plate for heat dissipation for heat generated by the LED plate. In other words, a part of the metal cup may be attached to the LED plate to carry heat of the LED plate to other place to perform heat dissipation. Fins may be disposed on the metal cup. The metal cup may be made of aluminum or other heat dissipation material.

In addition, heat dissipation air may be injected inside the space containing the LED plate. For example, the manufacturing process may be performed automatically with robot because such LED apparatus is easy to be assembled. A working space filled with He or other heat dissipation gas may be used so that when the lens plate is assembled, the heat dissipation air is kept inside the LED apparatus. This is optional but is particularly helpful particularly when the LED apparatus is used for spotlight purpose.

The lens plate has a central lens and a peripheral lens surrounding the central lens. The central lens guiding light from the LED modules for form a focus light beam for spotlight function.

The cup body has a dome portion, a tube portion and a bottom portion. The dome portion and the tube portion are manufactured together as a single body. The lens plate is fixed to a top peripheral end of the dome portion of the cup body. The LED plate is disposed inside the dorm portion so that a portion of light emitting from the LED modules running through the central lens of the lens plate to form a focus light beam and another portion of light emitting from the LED modules running through the peripheral lens to form soft light.

The driver plate contains driver circuits, two output terminals and two input terminals.

The two metal pins are integrated to the bottom portion of the cup body. The two input terminals of the driver plate are connected to the two metal pins and the two output terminals are connected to the LED plate via the through hole of the metal cup.

The LED modules may each be a single LED chip or multiple LED chips formed as a module.

Different lens plate may be prepared for generating spotlight apparatuses with different light beam characteristics while the other components kept unchanged.

Therefore, a detachable connection structure like screw or clips may be designed so that users may change a different lens plate to fit their needs. For example, a user may buy such spotlight apparatus with a number of lens plates with different central lens settings. The user may replace the default lens plate with another lens plate, e.g. to emit a more wide light beam or a narrower light beam. In addition, different colors of lens plate may be designed so that users may change a different color filter to affect the light beam from such spotlight apparatus.

In a specific example, there is a neck portion between the dorm portion and the tube portion. There is a first distance between where the LED plate is disposed and the neck portion. There is a second distance between the top peripheral and the neck portion. The first distance is smaller than half of the second distance and larger than one fourth of the second distance.

In another example, the LED plate is placed at the neck portion.

In another specific example, there are diffusion optical structures formed on the dorm portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals has form changing and increasing force to fix to the metal pins.

In another specific example, the two metal pins are molded with the bottom portion of the cup body. For example, the metals are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

In an example, the LED apparatus may further have a metal dome, the metal dome being placed inside and adjacent to the dome portion of the cup body. The bottom of the metal dorm may have a peripheral area connecting to the metal cup for help heat dissipation.

In another example, a plurality of protrusion structures are arranged regularly on an exterior surface of the dorm portion of the cup body. For example, the protrusion structures form associated of lens facing to the corresponding metal dome inside the dorm portion. With such design, heat dissipation is further achieved while the metal cup has better appearance.

In another example, the bottom surface of the metal cup has at least one through hole and the output terminals go through the through hole to connect to the LED plate. The metal cup may have several parts with one part connecting to the LED plate and another part connecting to the driver plate to perform heat dissipation from different sources. In the LED apparatus, the driver plate and the LED plate are two major heat sources that needs heat dissipation.

In another example, the bottom surface of the metal cup has at least one through hole and the driver plate goes through the through hole to electrically connected to the LED plate.

In another example, the central lens of the lens plate has a plurality of micro optical structures for forming a focus light beam by guiding optical path of the LED plate. Compared with one single lens, such micro optical structure may prevent uncomfortable light effect when people stare at the LED apparatus.

In a specific example, the plurality of micro optical structures are formed in a back side facing to the LED plate. Furthermore, a top side of the central lens opposite to the back side of the central lens has a smooth surface without protrusion structure. In other words, the top surface of the LED apparatus exposing outside may be well protected without hurting the lens during movement or installation. Besides, it would be easier to clean the surface of the LED apparatus.

In a specific example, the LED modules are placed under the central lens.

In a specific example, the dome portion has a detachable structure for replacing the lens plate to another lens plate to change light beam effect of the lens plate.

DETAILED DESCRIPTION

Figure 1:
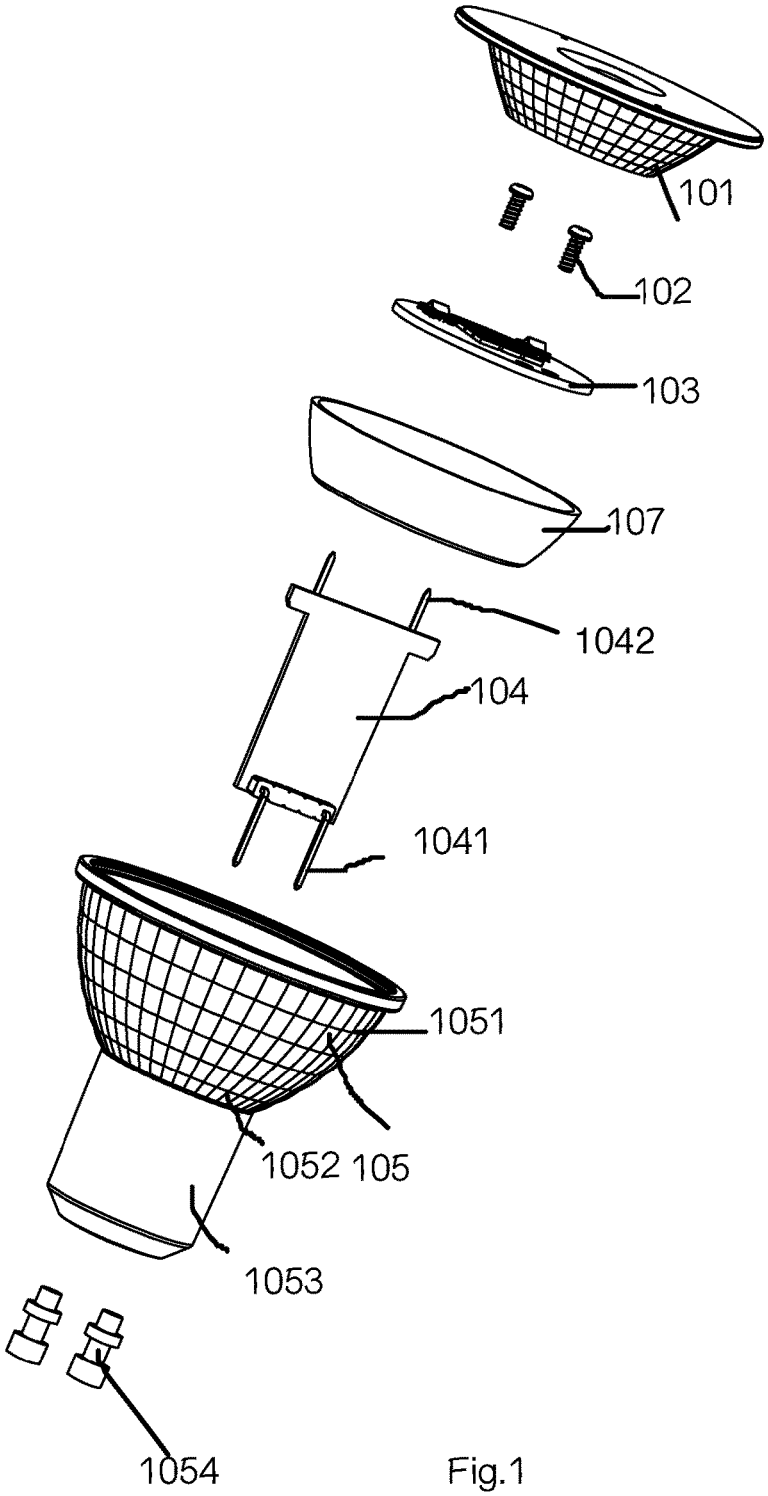
FIG. 1 illustrates an exploded diagram of components of a LED apparatus embodiment according to the present invention.
Figure 5:
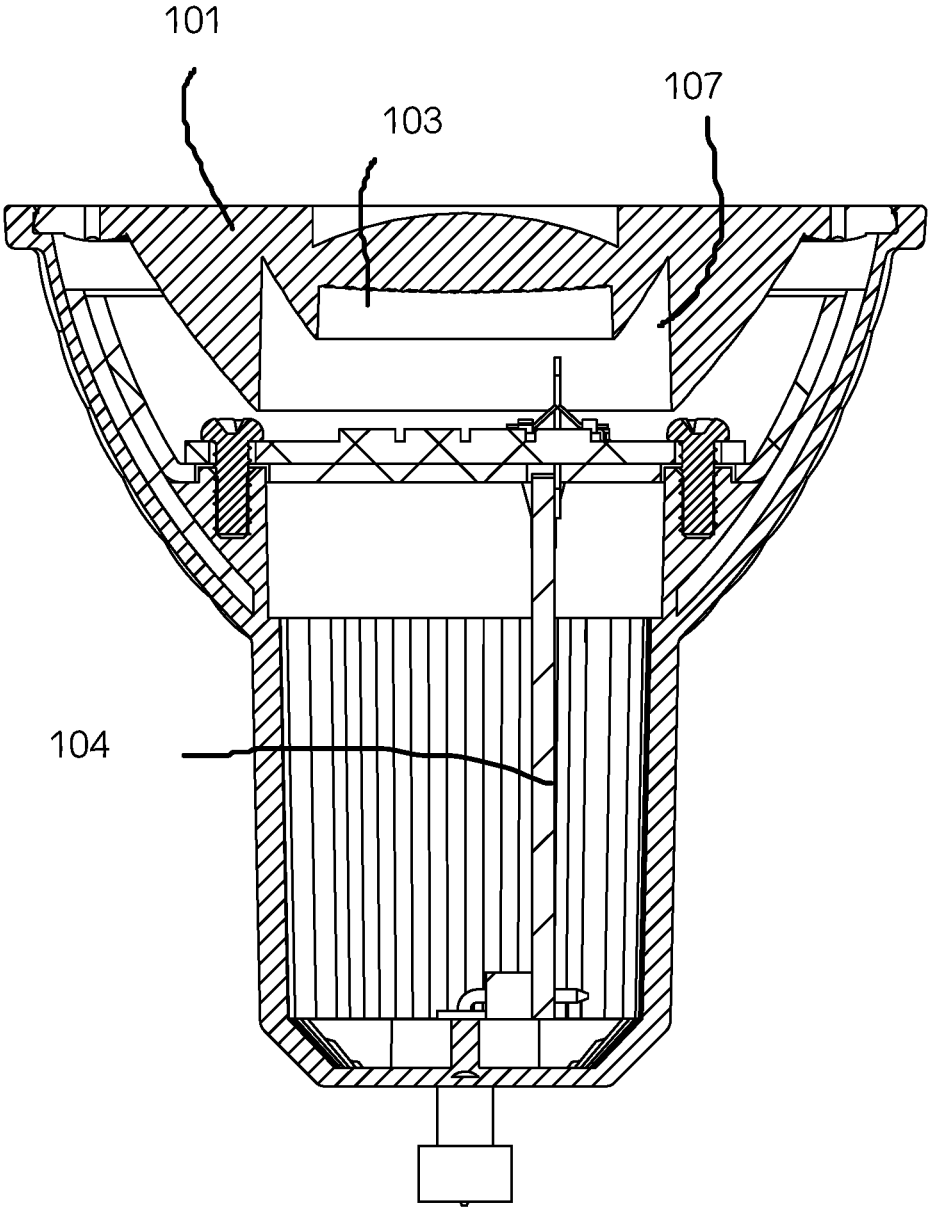
FIG. 5 is a side view of the spot light embodiment of FIG. 1 when the spotlight is assembled.

Please refer to FIG. 1 and FIG. 5. FIG. 1 illustrates an exploded diagram of components of a LED apparatus. FIG. 5 illustrates a side view of cross-sectional diagram of the components of FIG. 1 when they are assembled together.

The spotlight apparatus has a LED plate 103, a lens plate 101, a cup body 105, a driver plate 104, a pair of screws 102 for fixing the components.

The LED plate 103 has a plurality of LED modules, a metal plate and two connectors. The plurality of LED modules and the two connectors are mounted on the metal plate. The LED modules may each be a single LED chip or multiple LED chips formed as a module.

Figure 2A:
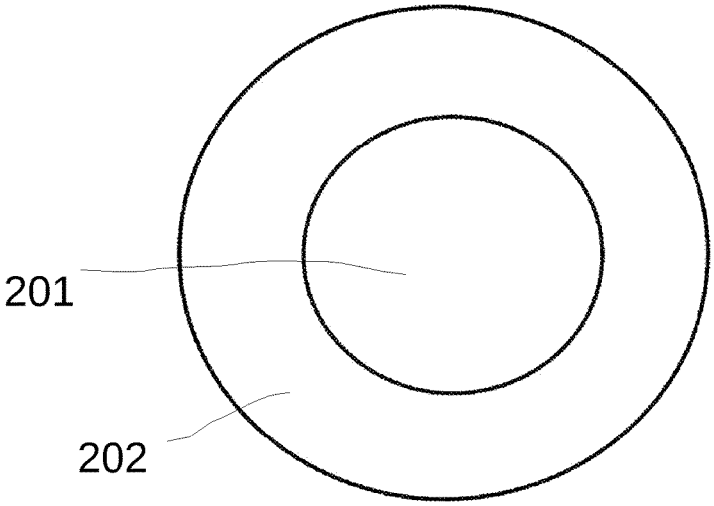
FIG. 2A illustrates an embodiment of a lens plate.
Figure 2B:
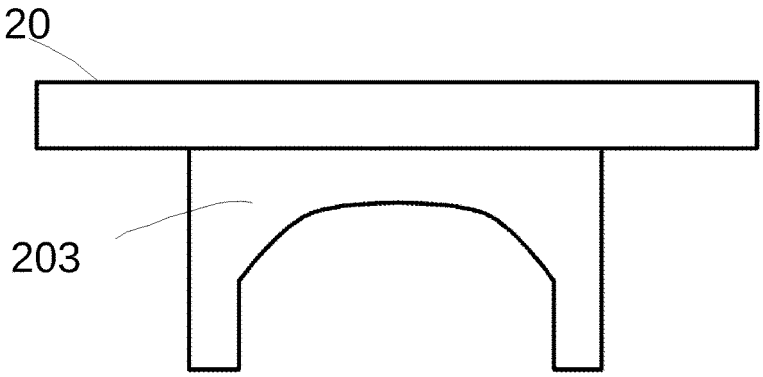
FIG. 2B illustrates side view of FIG. 2A.

Please refer to FIG. 2A and FIG. 2B, which illustrate a lens plate example. In FIG. 2A and FIG. 2B, the lens plate is a circular shape and has a central lens 201 and a plurality of micro optical structures 202 around the central lens. Micro optical structures are patterns including concave or other structure that may guide or change light paths to achieve certain optical effect. FIG. 2B is a side view of FIG. 2A. The lens plate 20 has a transparent hollow cup 203 structure for guiding light entering the central lens 201. The central lens 201 may be made of a single lens or multiple lens that generates the effect of creating a spotlight beam.

Different lens plate may be prepared for generating spotlight apparatuses with different light beam characteristics while the other components kept unchanged.

Therefore, a detachable connection structure like screw or clips may be designed so that users may change a different lens plate to fit their needs. For example, a user may buy such spotlight apparatus with a number of lens plates with different central lens settings. The user may replace the default lens plate with another lens plate, e.g. to emit a more wide light beam or a narrower light beam. In addition, different colors of lens plate may be designed so that users may change a different color filter to affect the light beam from such spotlight apparatus.

Please refer back to FIG. 1. The cup body 105 has a dome portion 1051, a tube portion 1053 and a bottom portion, which facing to and integrated with two metal pins 1054. The dome portion 1051 and the tube portion 1053 are manufactured together as a single body. The lens plate 101 is fixed to a top peripheral end of the dome portion 1051 of the cup body 105. The LED plate 103 is disposed inside the dorm portion 1051 so that a portion of light emitting from the LED modules running through the central lens of the lens plate 101 to form a focus light beam and another portion of light emitting from the LED modules running through the plurality of micro optical structures to form soft light. The plurality of micro optical structures may be designed to diffuse the light or made of tiny cave, blocks or dots. The central lens may also be made of multiple lens structures instead of a single lens.

In addition, a metal cup 107 is used for mounting the LED plate 103. A bottom surface of the metal cup is attached to the back side of the LED plate for heat dissipation for heat generated by the LED plate. The metal cup 107 has peripheral portion for increasing heat dissipation area. Fins or other structures may also be applied to design the metal cup 107. Furthermore, the peripheral portion of the metal cup 107 may be designed to engage with the dome portion 1051 of the cup body to increase heat dissipation effect.

The driver plate 104 contains driver circuits, two output terminals and two input terminals.

The two metal pins 1054 are integrated to the bottom portion of the cup body 105. The two input terminals 1041 of the driver plate 104 are inserted into the two metal pins 1054 and the two output terminals 1042 connected to the LED plate 103.

In a specific example, there is a neck portion 1052 between the dorm portion and the tube portion.

Figure 3:
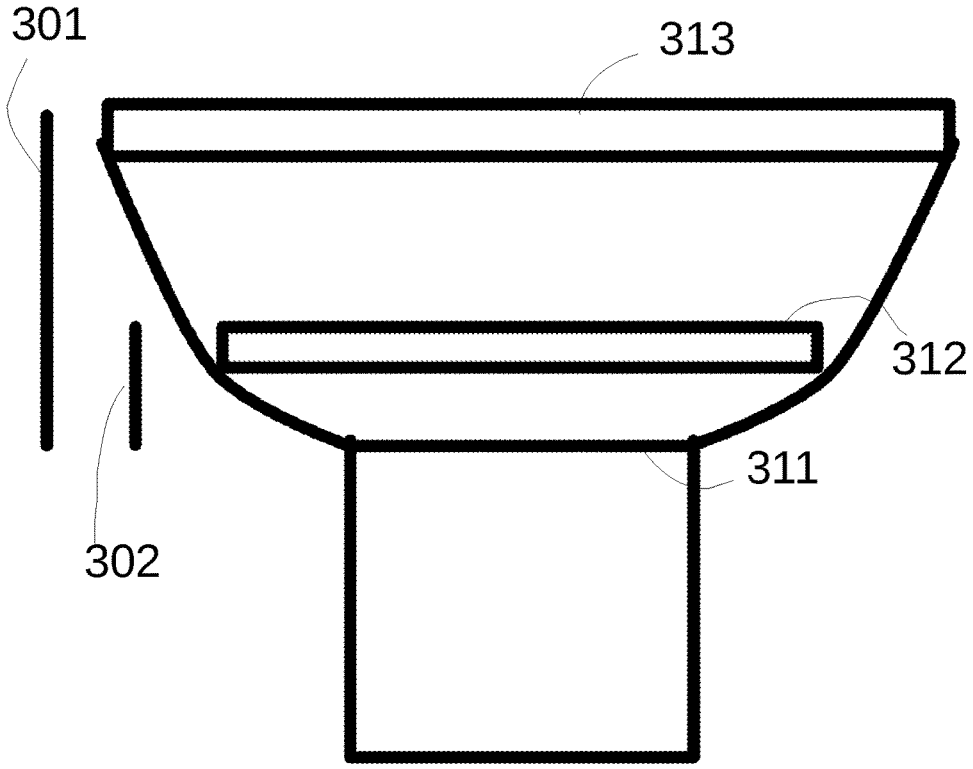
FIG. 3 illustrates a cup body embodiment.

Please also refer to FIG. 3. There is a first distance 302 between where the LED plate 312 is disposed and the neck portion 311. There is a second distance 301 between the top peripheral 313 and the neck portion 311. The first distance 302 is smaller than half of the second distance 301 and larger than one fourth of the second distance 301. For example, the first distance 302 is about ⅓ of the second distance 301. Such arrangement makes both light efficiency and heat dissipation for leaving space for heat movement.

In another specific example, there are diffusion optical structures formed on the dorm portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals has form changing and increasing force to fix to the metal pins.

In another specific example, the two metal pins are molded with the bottom portion of the cup body. For example, the metals are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

Figure 4:
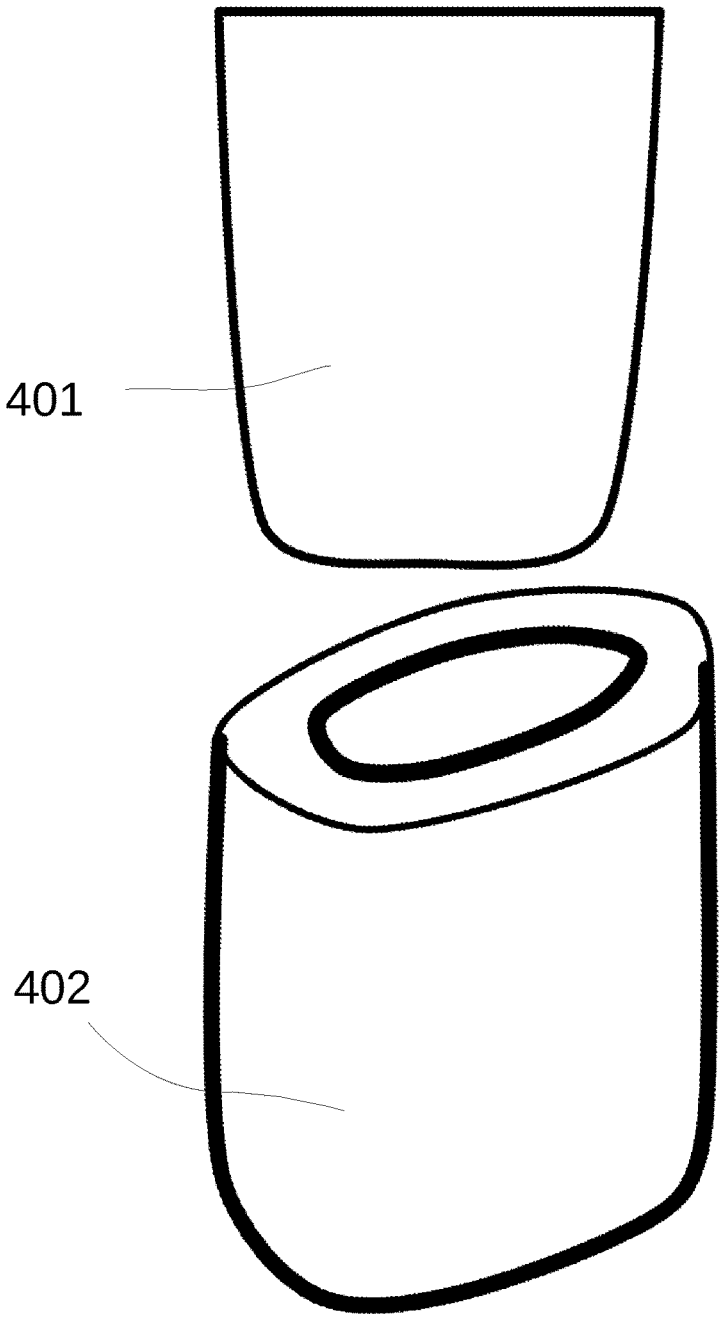
FIG. 4 illustrates a diagram of metal pins and input terminals.

Please refer to FIG. 4, which illustrates interaction between an input terminal of a driver plate 401 and a metal pins 402. The front end of the input terminal is inserted into a hole of the metal pins 402. In addition, a deformation of the inserted portion of the input terminal 401 would help fixing better for the input terminal 401 and the metal pins 402. In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

Figure 6:
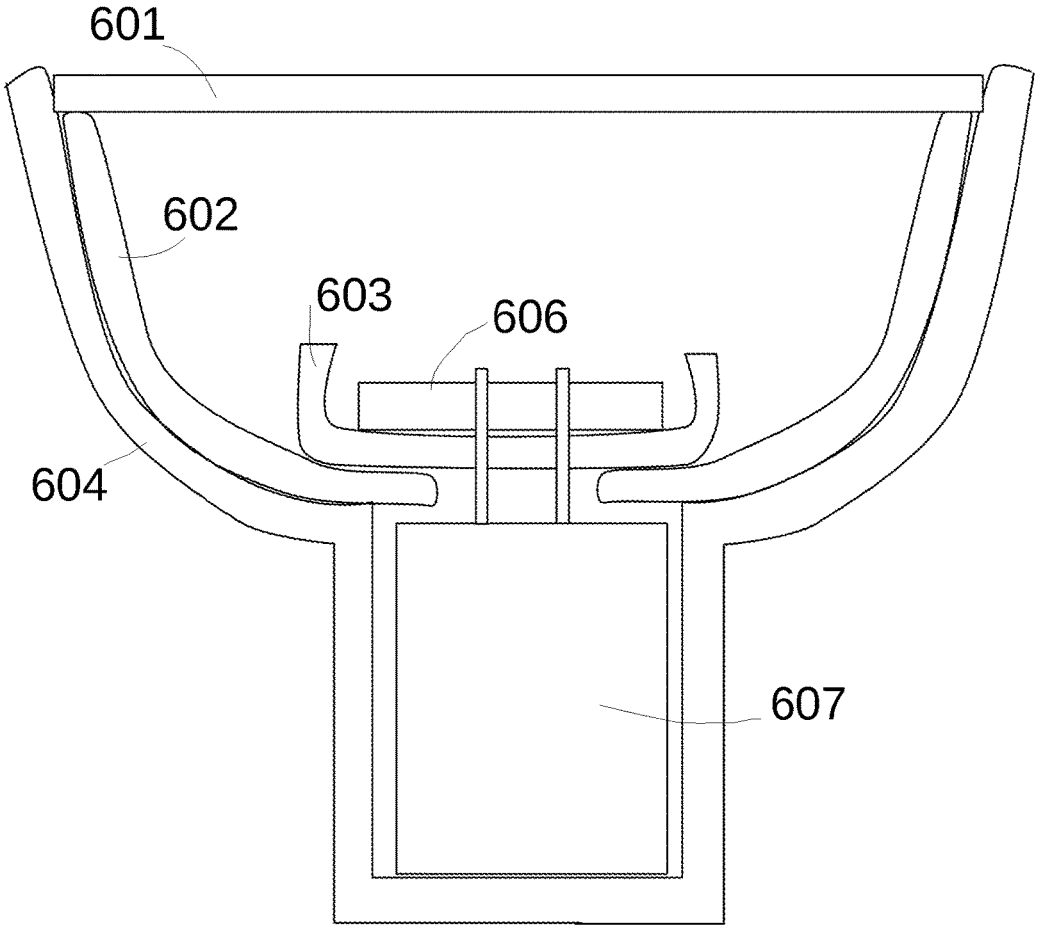
FIG. 6 illustrates another embodiment with a metal dorm.

Please refer to FIG. 6, which illustrates a cross sectional view of another embodiment. In FIG. 6, the LED apparatus has a lens plate 601, a cup body 604, a driver plate 607, a metal cup 603 and a LED plate 606. In addition, the LED apparatus further has a metal dorm 602. The metal dome 602 is placed inside and adjacent to the dome portion of the cup body 604. A bottom portion of the metal dorm 602 may contact with the metal cup 603 for helping carrying heat to the dorm portion of the cup body 604. The metal dorm 602 may have a dorm shape similar to the dorm portion of the cup body 604 so that these two components may contact to each other to perform heat dissipation.

The embodiments mentioned above should not be interpreted as limitation for the present invention. Persons of ordinary skilled in the art would be able to create equivalent designs under protection scopes.

The invention claimed is:

1. An LED apparatus comprising:

a LED plate comprising a plurality of LED modules, a base plate and two connectors, the plurality of LED modules and the two connectors being mounted on the base plate;

a metal cup having a bottom surface attaching to a back side of the base plate for heat dissipation for heat generated by the LED plate;

a lens plate, comprising a central lens and a peripheral lens surrounding the central lens, the central lens guiding light from the LED modules for form a focus light beam;

a cup body comprising a dome portion, a tube portion and a bottom portion, the dome portion and the tube portion being manufactured together as a single body, the lens plate being fixed to a top peripheral end of the dome portion of the cup body, the LED plate being disposed inside the dorm portion so that a portion of light emitting from the LED modules running through the central lens of the lens plate to form a focus light beam and another portion of light emitting from the LED modules running through the peripheral lens to form soft light;

a driver plate containing driver circuits, two output terminals and two input terminals; and two metal pins integrated to the bottom portion of the cup body, the two input terminals of the driver plate inserted into the two metal pins and the two output terminals connected to the LED plate via the through hole of the metal cup.

2. The LED apparatus of claim 1, further comprising a metal dome, the metal dome being placed inside and adjacent to the dome portion of the cup body.

3. The LED apparatus of claim 2, wherein a plurality of protrusion structures are arranged regularly on an exterior surface of the dorm portion of the cup body, the protrusion structures forming associated of lens facing to the corresponding metal dome inside the dorm portion.

4. The LED apparatus of claim 1, wherein the bottom surface of the metal cup has at least one through hole and the output terminals go through the through hole to connect to the LED plate.

5. The LED apparatus of claim 1, wherein the bottom surface of the metal cup has at least one through hole and the driver plate goes through the through hole to electrically connected to the LED plate.

6. The LED apparatus of claim 1, wherein the central lens of the lens plate has a plurality of micro optical structures for forming a focus light beam by guiding optical path of the LED plate.

7. The LED apparatus of claim 6, wherein the plurality of micro optical structures are formed in a back side facing to the LED plate.

8. The LED apparatus of claim 7, wherein a top side of the central lens opposite to the back side of the central lens has a smooth surface without protrusion structure.

9. The LED apparatus of claim 1, wherein the LED modules are placed under the central lens.

10. The LED apparatus of claim 1, wherein the dome portion has a detachable structure for replacing the lens plate to another lens plate to change light beam effect of the lens plate.

11. The LED apparatus of claim 1, wherein the two metal pins have openings respectively for receiving the two input terminals of the driver plate.

12. The LED apparatus of claim 11, wherein the two metal pins are metal hollow tubes.

13. The LED apparatus of claim 12, wherein a portion of the input terminals of the driver plate is deformed when the input terminals are inserted into the openings of the two metal pins to keep better connection between the input terminals and the two metal pins.

14. The LED apparatus of claim 11, wherein the two metal pins are molded with the bottom portion of the cup body.

15. The LED apparatus of claim 1, wherein the dome portion, the tube portion and the bottom portion of the cup body are together formed with Polycarbonate material as a single body.

* * * * *